US005938482A

United States Patent [19]

Yamatani

[11] Patent Number: 5,938,482

[45] Date of Patent: Aug. 17, 1999

[54] CONNECTOR WITH TERMINAL LOCKING MEMBER

[75] Inventor: Eiji Yamatani, Tokyo, Japan

[73] Assignee: Kansei Corporation, Japan

[21] Appl. No.: 08/933,305

[22] Filed: Sep. 18, 1997

[30] Foreign Application Priority Data

Sep. 18, 1996 [JP] Japan ..... 8-246048

[51] Int. Cl.[6] ..... H01R 13/434

[52] U.S. Cl. ..... 439/752

[58] Field of Search ..... 439/752, 595

[56] References Cited

U.S. PATENT DOCUMENTS

| | | | |
|---|---|---|---|
| 5,569,055 | 10/1996 | Yamanashi et al. | 439/595 |
| 5,658,168 | 8/1997 | Myer et al. | 439/595 |
| 5,746,624 | 5/1998 | Ohsumi et al. | 439/595 |
| 5,769,664 | 6/1998 | Saito et al. | 439/595 |

FOREIGN PATENT DOCUMENTS 7-58629 6/1995 Japan .

*Primary Examiner*—Gary F. Paumen
*Attorney, Agent, or Firm*—Morrison Law Firm

[57] ABSTRACT

A connector for connecting a wire harness with a terminal locking member improves reliability by preventing the adverse effects of outside forces and makes it possible to make a smooth connection. The connector 21 with terminal locking member has flexible members 24*b* in terminal accommodation chambers 24 whereby when terminal locking member 25 is in a temporary connecting condition with respect to connector housing 22, the flexible members come into contact with arms 26*a* and keep in check any further insertion of these arms 26*a* in housing 22, and by inserting terminal 27 into terminal accommodation chambers 24, they become displaced and further insertion of arms 26*a* is allowed, making possible the regular connecting condition of terminal locking member 25 to connector housing 22.

2 Claims, 5 Drawing Sheets

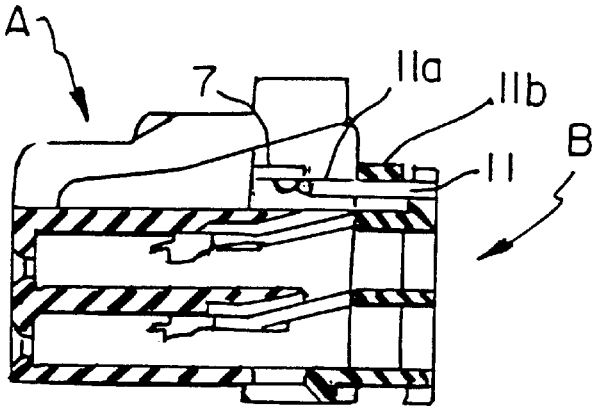
FIG. 7(a)
PRIOR ART
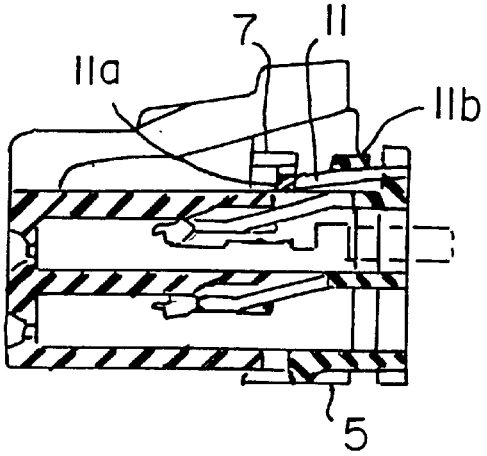
FIG. 7(b)
PRIOR ART
FIG. 7(c)
PRIOR ART
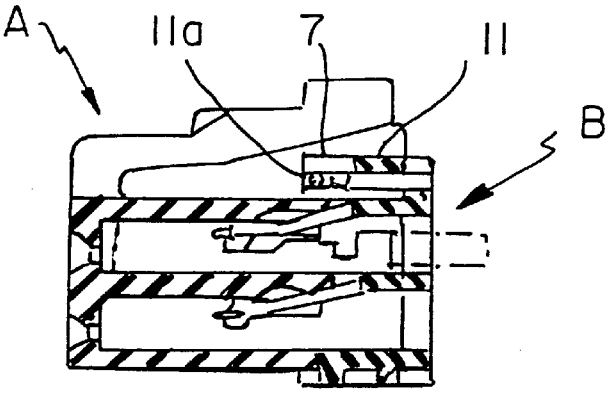

CONNECTOR WITH TERMINAL LOCKING MEMBER

BACKGROUND OF THE INVENTION

The present invention relates to a connector for connection of a wire harness and, more particularly, to a connector having a terminal locking member and wherein the terminal locking member that locks a terminal to a connector housing connects to the connector housing in such way that no transition is made from a temporary connecting condition to a regular connecting condition unintentionally.

A previously known connector for connection of a wire harness is disclosed in Japanese Patent Publication No. HEI 7-58629.

As shown in FIGS. 7(*a*)–7(*c*) herein, the known connector consists of connector housing A and terminal locking member B, which connects to connector housing A in two stages, a temporary connecting condition and a regular connecting condition.

In the temporary connecting condition shown in FIG. 7(*a*), misinsertion prevention part 7, which is provided on connector housing A, and collision protrusion part 11*a*, which is provided on terminal locking member B, face each other, thereby preventing terminal locking member B from being unintentionally put into regular connecting condition with respect to connector housing A.

And in the temporary connecting condition shown in FIG. 7(*b*), by digital or hand applied pressing down on manipulation part 11*b*, which is provided on terminal locking member B, misinsertion prevention flexible member 11 is bent downward, releasing the facing-each-other relationship between collision protrusion part 11*a* and misinsertion prevention part 7.

And from this condition, as shown in FIG. 7(*c*), by pressing terminal locking member B toward connector housing A, terminal locking member B can move into regular connecting condition with respect to connector housing A.

In doing so, in order to go from temporary connecting condition to regular connecting condition, regular connecting condition cannot be reached unless one intentionally pushes down on manipulation part 11*b* and separates misinsertion prevention flexible member 11 from misinsertion prevention part 7.

However, with a mechanism such as described above, in order to be able to manually operate manipulation part 11*b* to release the misinsertion prevention, it is necessary to expose manipulation part 11*b* to the outside, and because of this, there is the problem that if, while in temporary connecting condition, some outside force should unexpectedly press down on manipulation part 11*b*, then terminal locking member B will be misinserted.

Moreover, if, by increasing the rigidity of misinsertion prevention flexible member 11, one attempts to prevent misinsertion of terminal locking member B into connector housing A even if an unexpected pressing force is applied to manipulation part 11*b*, then it sometimes becomes difficult to insert terminal locking member B to achieve a regular connecting condition, thus making it impossible to make the connection.

OBJECTS AND SUMMARY OF THE INVENTION

Accordingly, it is an object of the invention to provide a connector with terminal locking member which overcomes the drawbacks of the prior art.

Another object of the invention to provide a connector with terminal locking member that functions to prevent regular locking of a terminal unless a user intends that such be effected.

It is a still further object of the invention to provide a connector with terminal locking member which reliably holds the terminal locking member in temporary connecting condition without hazard that unexpected force applied thereagainst will move the terminal locking member into regular connecting condition.

Briefly stated, there is provided a connector for connecting a wire harness with a terminal locking member which improves reliability by preventing the adverse effects of outside forces and make it possible to make a smooth connection. The connector has flexible members in terminal accommodation chambers of a connector housing. When the terminal locking member is in temporary connecting condition with respect to the connector housing, the flexible members come into contact with arms on the locking member. These flexible members keep in check any further insertion of these arms into the housing. By inserting a terminal into the terminal accommodation chambers, the flexible members become displaced and further insertion of the arms is allowed, making possible the regular connecting condition of the terminal locking member to the connector housing.

In accordance with these and other objects of the invention, there is provided a connector with terminal locking member, comprising a connector housing having openings in an end face thereof and terminal accommodation chambers into which terminals can be inserted through said openings. The connector includes a terminal locking member that connects to said end face side of said connector housing through successive two stages of a temporary connecting condition and a regular connecting condition. Arms on the terminal locking member are insertable into said terminal accommodation chambers through said openings. Flexible members in provided in said terminal accommodation chambers so that when said terminal locking member is in temporary connecting inserted condition with respect to said connector housing, said flexible members in a protruding state contact said arms and hold in check any further insertion of said arms. With a further insertion movement of said arms into said terminal accommodation chambers, said flexible members are caused to be displaced by inserting a terminal into a terminal accommodation chamber and allow full insertion of said arms into the accommodation chambers thereby effecting a regular connecting condition of said terminal locking member to said connector housing. A fore part of said arms in fully inserted position thereof engage a rear end of the terminals received in said accommodation chambers to prevent said terminals from being pulled out of said accommodation chambers.

According to a feature of the invention there is provided a connector assembly for terminals comprising a connector housing, said connector housing having openings in an end thereof and terminal accommodation chambers therein into which terminals can be inserted through said openings. A terminal locking member also is provide and said terminal locking member carrys arms that are insertable into said terminal accommodation chambers. The connector housing carrys flexible members which protrude into said accommodation chambers, the arms on said terminal locking member when said terminal locking member is in temporary connecting inserted condition being checked against a further insertion into the terminal accommodation chambers by a contact with the flexible members. When a terminal thereafter is inserted into an accommodation chamber such causes the flexible member therein to be displaced to an unchecking position whereby further insertion travel of an arm in the accommodation chamber with attendant movement of the terminal locking member to a regular connecting condition can occur, a tip end of the arm engaging a rear end of the terminal in said regular connecting condition to prevent pull out of the terminal from the accommodation chamber.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 7(*a*) is a cross-sectional view showing the temporary connecting condition of a connector with terminal locking member as in the prior art;

FIG. 7(*b*) is a cross-sectional view showing the operation for releasing misinsertion prevention of a connector with terminal locking member as in the said prior art; and FIG. 7(*c*) is a cross-sectional view showing the prior art regular connecting condition of a connector with terminal locking member.

DETAILED DESCRIPTION OF THE PREFERRED EMBODIMENT

Figure 1:
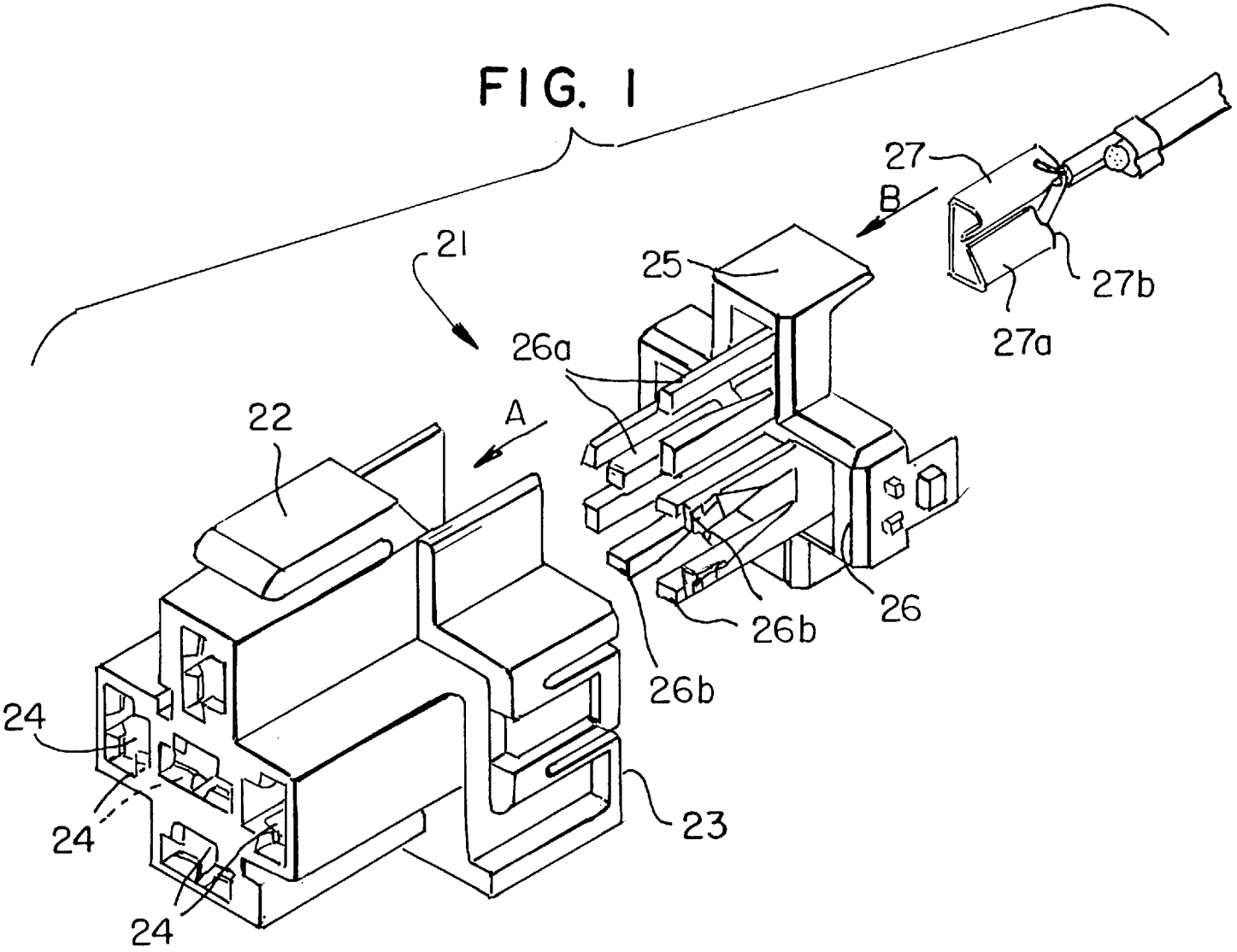
FIG. 1 is an exploded perspective view of a connector with locking member relating to an embodiment of this invention.

Modes of implementation of the invention are described in the following, with reference to FIGS. 1–6.

Referring to FIGS. 1–4, 21 is the connector with terminal locking member and 22 is the connector housing, the connector housing having an end face as at 23. the connector housing 22 has terminal accommodation chambers 24, and these terminal accommodation chambers 24 have terminal insertion openings (openings) 23*a* that lie open on end face 23.

The terminal accommodation chambers 24 are provided with case lances 24*a* for preventing pull out of a terminal received in the chambers. The chambers also carry flexible members 24*b*, and a bending side space 24*c* is provided so that the flexible members 24*b* can be pressed and displaced toward terminal 27. In addition, arms 26*a* are formed on terminal locking member 25. Protruding from terminal end face 26 of terminal locking member 25 and facing terminal accommodation chambers 24, are the ends 26*b* of arms 26*a*.

Figure 3:
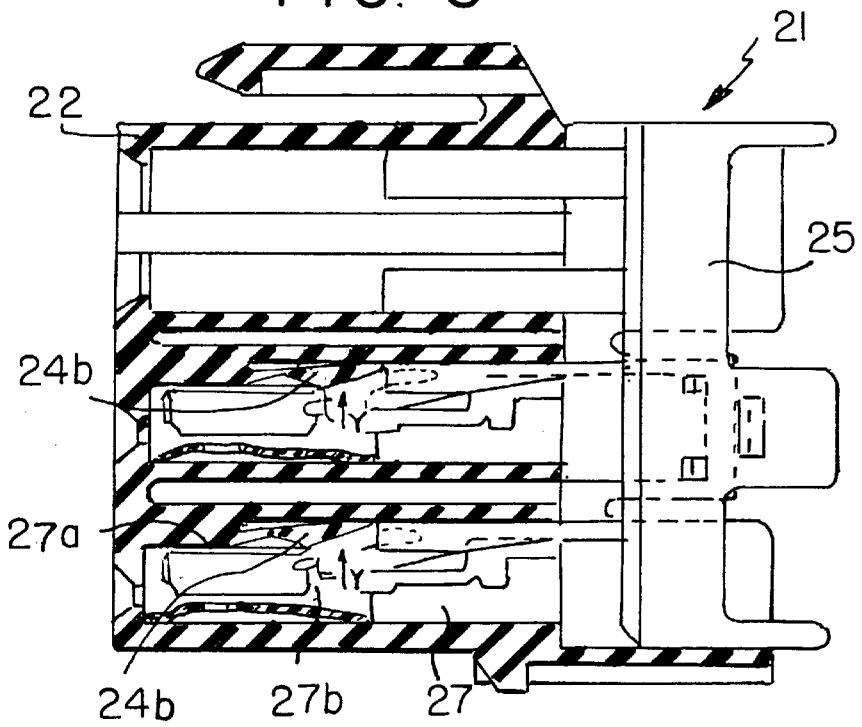
FIG. 3 is a cross-sectional view showing, in the FIG. 2 temporary connecting condition in the state in which the terminal is inserted into the terminal accommodation chambers.

In FIG. 3 showing how the terminal is inserted into the terminal accommodation chambers in temporary connecting condition, it is seen that terminal 27 has an upper end 27*a* and that this touches a lower part of flexible member 24*b*, a terminal rear end 27*b* touching case lance 24*a*.

Figure 4:
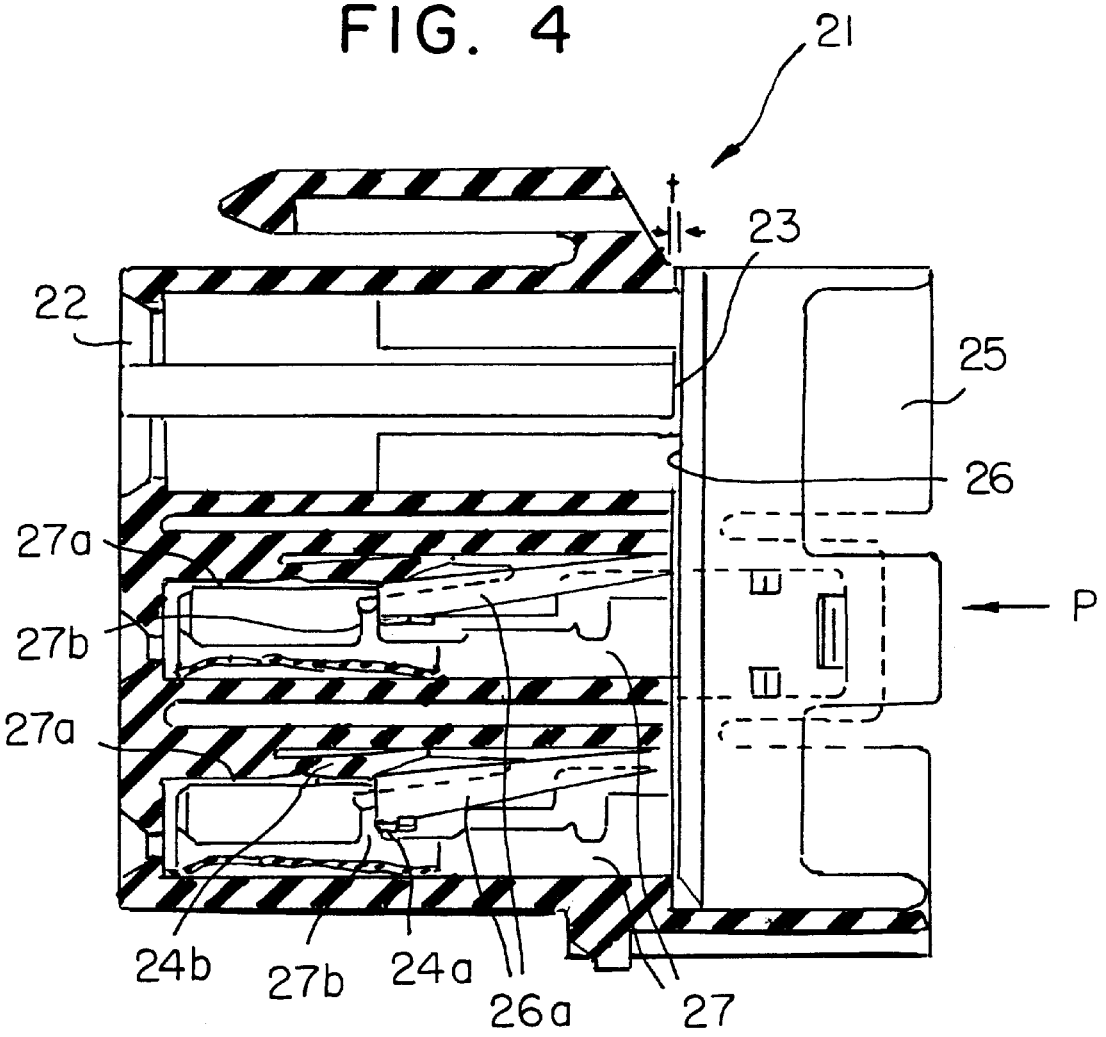
FIG. 4 is a cross-sectional view showing the regular connecting condition of the connector with terminal locking member relating to FIG. 1.
Figure 5:
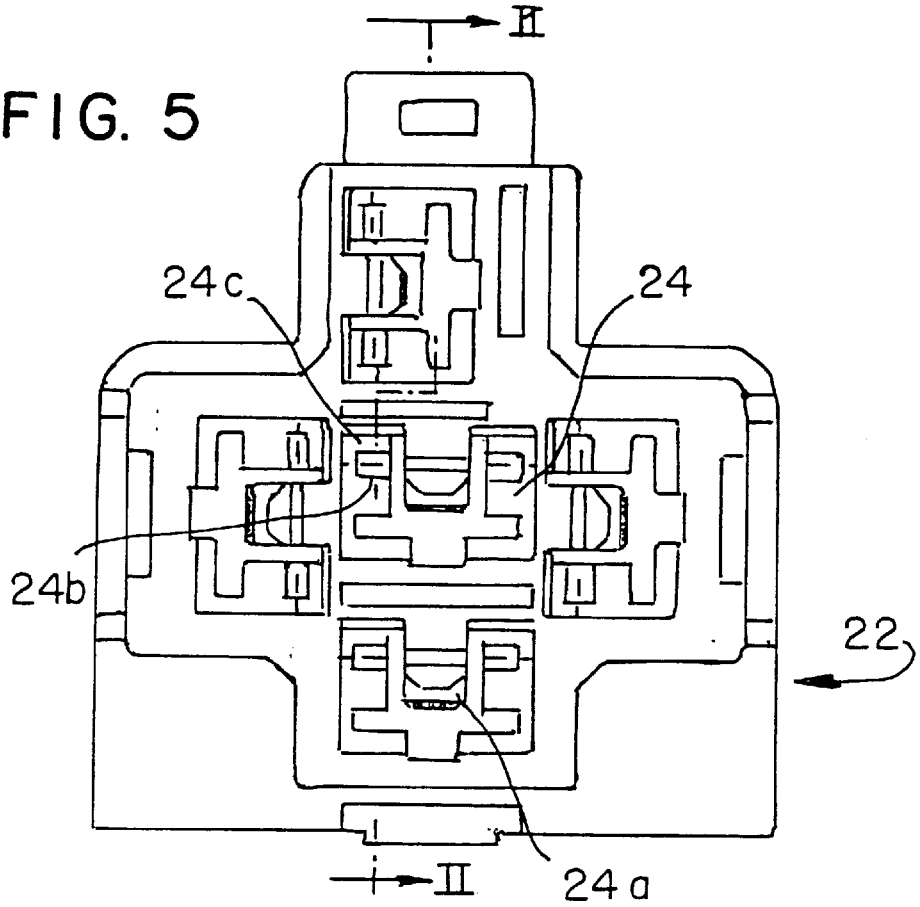
FIG. 5 is the view denoted by looking in the direction of arrow A in FIG. 1.
Figure 6:
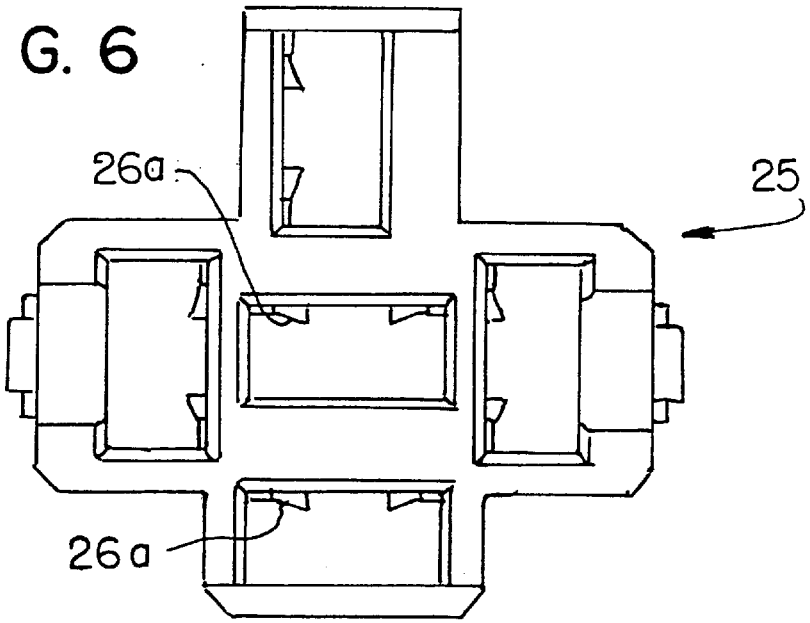
FIG. 6 is the view denoted by looking in the direction of arrow B in FIG. 1.

From the FIG. 4 showing of the regular connecting condition of the connector with the terminal locking member, it is seen that a small gap (t) is formed between the respective connector housing and connector end faces 23, 26 when terminal locking member 25 is in regular connecting condition with connector housing 22.

Manner of the operation of the connector with terminal locking member is given next.

Figure 2:
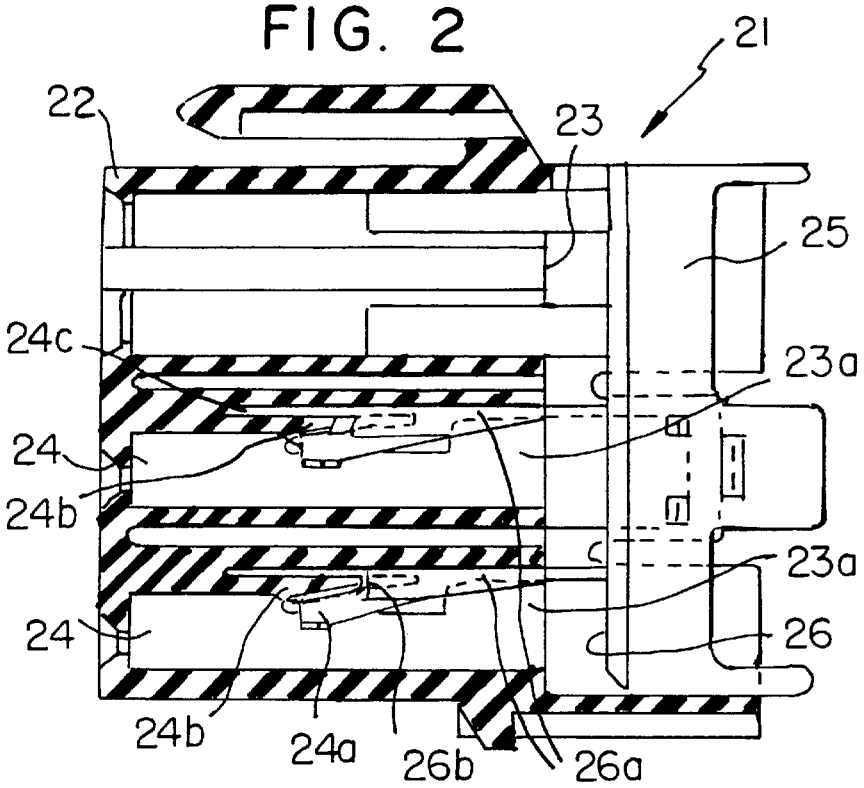
FIG. 2 is a cross-sectional view taken on the line II—II in FIG. 5, and showing the temporary connecting condition of the connector with terminal locking member.

As shown in FIG. 2, terminal locking member 25 is connected to connector housing 22. Also, it is inserted as far as the position where facing flexible members 24*b* on terminal accommodation chambers 24 and arms 26*a* on terminal locking member 25 come into contact with each other, forming a temporary connecting condition.

As long as the state of contact between arms 26*a* and flexible members 24*b* is not intentionally released, no transition is made from this condition to the regular connecting condition even if terminal locking member 25 is pressed.

Referring to FIG. 3, by inserting terminal 27 into terminal accommodation chambers 24 in the temporary connecting condition shown in FIG. 2, upper end 27*a* of terminal 27 comes into contact with flexible members 24*b*, flexible members 24*b* are bent toward bending-side space 24*c* (in the direction shown by arrows Y) and are displaced as far as a position where they separate from ends 26*b* of arms 26*a*, and the constraint of the temporary connecting condition of terminal locking member 25 with respect to connector housing 22 is released.

In FIG. 4, from the state of FIG. 3, in which the constraint of the temporary connecting condition is released, when terminal locking member 25 is pressed in toward connector housing 22 in the direction indicated by the arrow P, arms 26*a* slide along the surface of flexible members 24*b* and come into contact with rear end 27*b* of terminal 27. Also, a small gap (t) is provided between end face 23 of connector housing 22 and end face part 26 of terminal locking member 25, and it is put into regular connecting condition by being moved so that the ends of arms 26*a* and the rear end come into secure contact.

In addition, case lance 24*a* and arms 26*a* are doubly connected to rear ends 27*b* of terminal 27 inserted into terminal accommodation chambers 24, forming a regular connecting condition in which terminal 27 is prevented from being pulled out.

These flexible members 24*b* may be provided on all of the multiple terminal accommodation chambers 24, or may be provided on one or two suitably selected positions.

From the foregoing it is seen that when the terminal locking member is in temporary connecting condition with respect to the connector housing, no transition is made from the temporary connecting condition to the regular connecting condition, even if an external effect is received, unless the contact condition is intentionally released, because flexible members 24*b* are provided in the terminal accommodation chambers so that arms 26*a* touch in a protruding state and any further insertion of said arms is held in check, and by inserting terminal 27 into the terminal accommodation chambers they become displaced, allowing the further insertion of arms 26*a*, and making possible the regular connecting condition of terminal locking member 25 into the connector housing.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A connector, comprising:

a connector housing having openings in an end face thereof and terminal accommodation chambers into which terminals can be inserted through said openings;

a terminal locking member that connects to said end face of said connector housing through successive two stages of a temporary connecting condition and a regular connecting condition;

arms on the terminal locking member insertable into said terminal accommodation chambers through said openings; and flexible members in said terminal accommodation chambers whereby when said terminal locking member is in the temporary connecting inserted condition with respect to said connector housing, said flexible members in a protruding state contact said arms and hold in check any further insertion of said arms, a further insertion movement of said arms into said terminal accommodation chambers being made possible by causing said flexible members to become displaced by inserting terminals into the terminal accommodation chamber, to allow full insertion of said arms into the accommodation chambers thereby effecting a regular connecting condition of said terminal locking member to said connector housing, a fore part of said arms in the fully inserted position thereof engaging a rear end of the terminals received in said accommodation chambers to prevent said terminals from being pulled out of said accommodation chambers.

2. Connector assembly for terminals comprising a connector housing, said connector housing having openings in an end thereof and terminal accommodation chambers therein into which terminals can be inserted through said openings, and a terminal locking member, said terminal locking member carrying arms that are insertable into said terminal accommodation chambers, said connector housing carrying flexible members which protrude into said accommodation chambers, the arms on said terminal locking member when said terminal locking member is in temporary connecting inserted condition being checked against a further insertion into the terminal accommodation chambers by contact with the flexible members, insertion thereafter of terminals into the accommodation chambers causing the flexible members therein to be displaced to an unchecking position whereby further insertion travel of the arms in the accommodation chambers, with attendant movement of the terminal locking member to a regular connecting condition can occur, tip ends of the arms engaging rear ends of the terminals in said regular connecting condition to prevent pull out of the terminals from the accommodation chambers.

* * * * *